United States Patent [19]

Bekker et al.

[11] 4,374,484

[45] Feb. 22, 1983

[54] COMPENSATOR FOR MUZZLE CLIMB

[75] Inventors: Marthinus J. Bekker; Douglas J. M. Hall, both of Salisbury, Southern Rhodesia

[73] Assignee: DRW Corporation, Troy, Mich.

[21] Appl. No.: 134,045

[22] Filed: Mar. 26, 1980

Related U.S. Application Data

[63] Continuation-in-part of Ser. No. 868,631, Jan. 11, 1978, Pat. No. 4,235,152.

[30] Foreign Application Priority Data

Jan. 12, 1977 [RH] Southern Rhodesia ..... 7/77
Oct. 17, 1977 [RH] Southern Rhodesia ..... 207/77

[51] Int. Cl.[3] ..... F41F 17/12
[52] U.S. Cl. ..... 89/14 C
[58] Field of Search ..... 89/14 C

[56] References Cited

U.S. PATENT DOCUMENTS

| | | | |
|---|---|---|---|
| 1,390,658 | 9/1921 | Towson | 89/14 C |
| 2,883,781 | 4/1959 | Harvey | 89/14 C |
| 3,858,481 | 1/1975 | Elliott | 89/14 C |
| 3,971,285 | 7/1976 | Ellis et al. | 89/14 C |

FOREIGN PATENT DOCUMENTS

| | | | |
|---|---|---|---|
| 2433564 | 1/1976 | Fed. Rep. of Germany | 89/14 C |
| 812261 | 5/1937 | France | 89/14 C |
| 14028 | of 1897 | United Kingdom | 89/14 C |
| 349239 | 5/1931 | United Kingdom | 89/14 C |

*Primary Examiner*—Stephen C. Bentley
*Attorney, Agent, or Firm*—Jay C. Taylor; Neal A. Waldrop

[57] ABSTRACT

A lift compensator for the muzzle end of a gun barrel comprises a tubular element detachably mountable on a flash hider for the gun. The element is rotatably adjustable on the flash hider to various preselected positions and has vents and deflectors selectively cooperable at each position with different ports of the flash hider for utilizing gases discharged therefrom transversely of the barrel and for redirecting those gases to compensate for a particular angle of muzzle lift.

15 Claims, 29 Drawing Figures

Fig-1
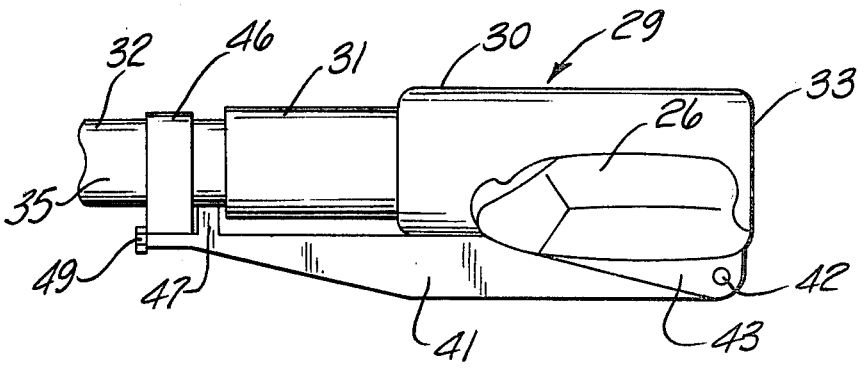
Fig-2
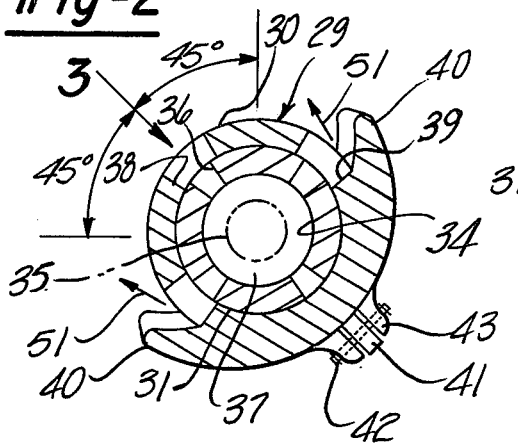
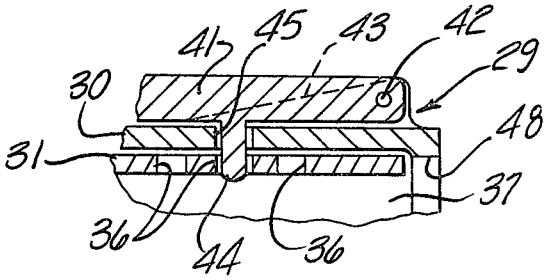
Fig-4
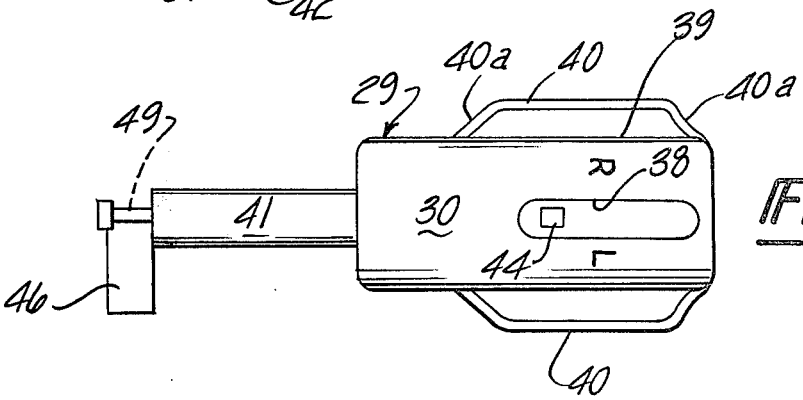
Fig-3
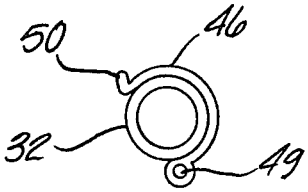
Fig-5

Fig-6
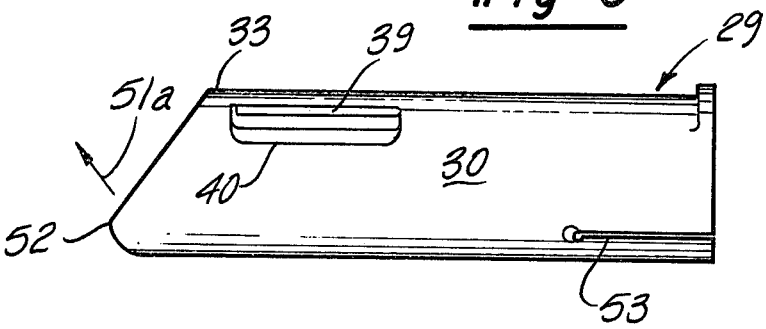
Fig-8
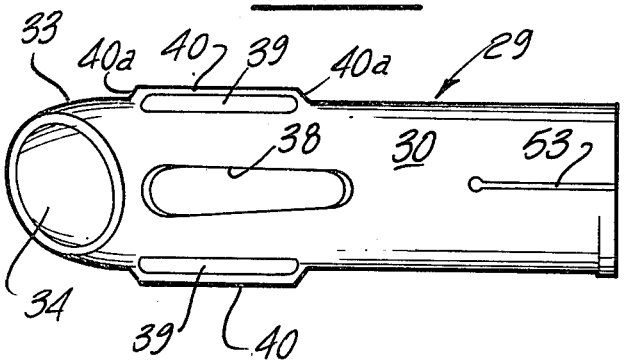
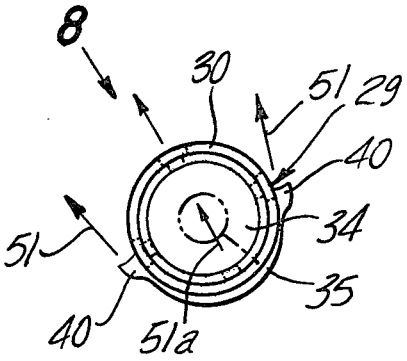
Fig-7
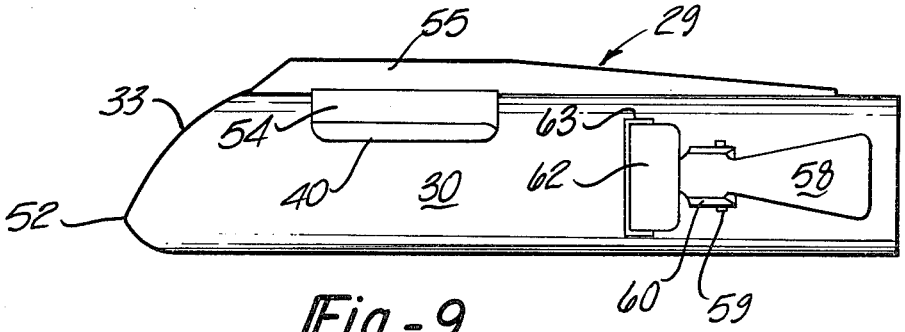
Fig-9
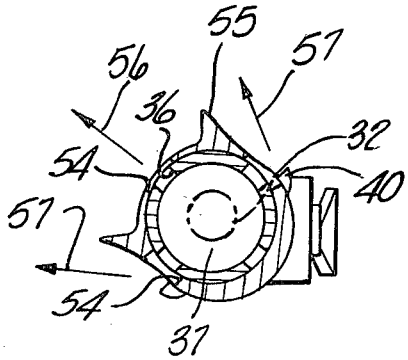
Fig-10

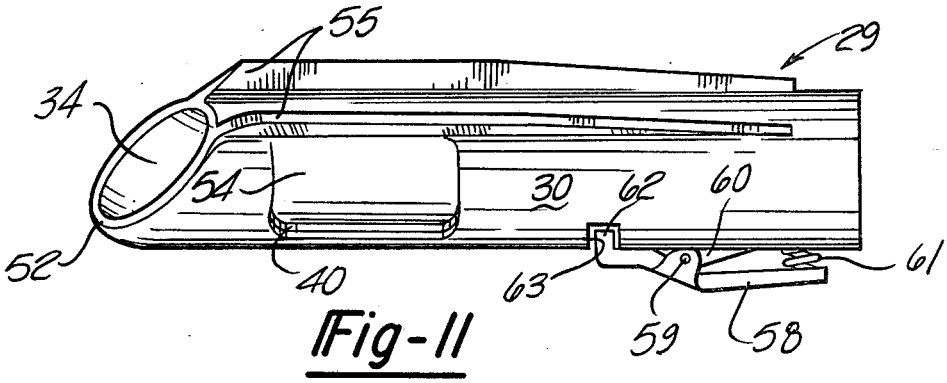
Fig-11
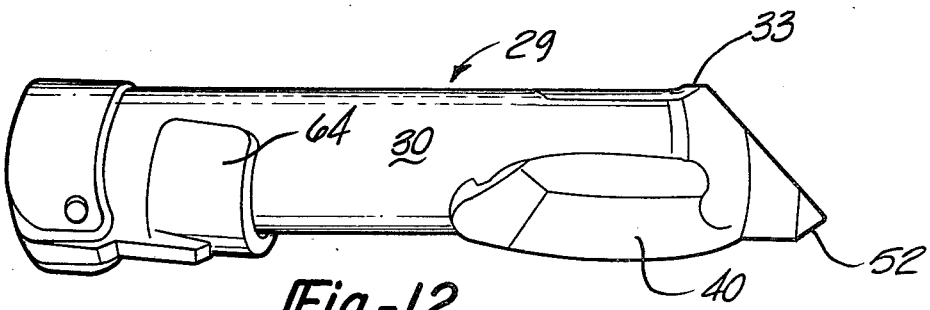
Fig-12
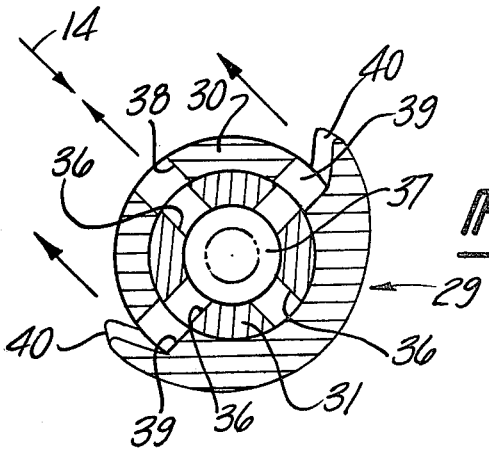
Fig-13
Fig-14
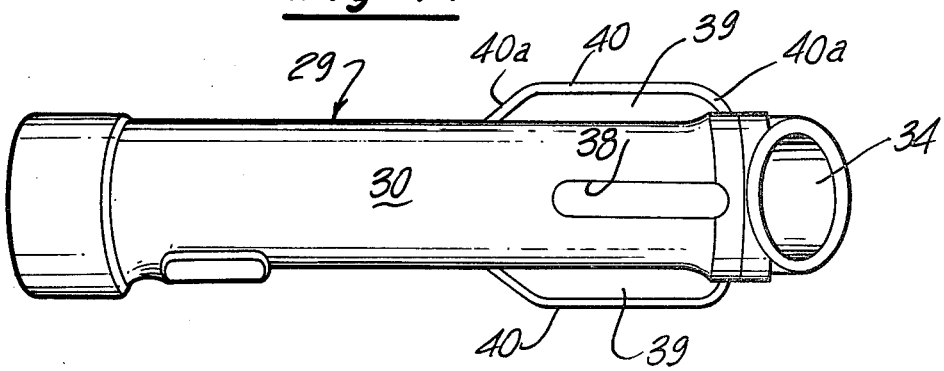

COMPENSATOR FOR MUZZLE CLIMB

This invention is a continuation-in-part of copending U.S. patent application Ser. No. 868,631, filed Jan. 11, 1978, now U.S. Pat. No. 4,235,152 and relates to guns and, in particular to lift compensators or stabilizers for guns, especially automatic rifles, machine guns, and the like.

BACKGROUND AND OBJECTS OF THE INVENTION

It is well known that the muzzle climb or lift when a gun is fired results from the reaction of the recoil against the support for the gun. The amount of lift is proportional to the recoil and the direction is determined by the manner in which the gun is supported, as for example by the body and arms of the person firing the gun. A right or left handed marksman holding a rifle in a typical right or left handed firing position respectively, will experience a rightward or leftward muzzle lift, respectively, at approximately 45° to the vertical, whereas a gun typically supported on a bipod where the lateral forces are balanced will exhibit a vertical lift.

Muzzle brakes have been provided to reduce recoil and thereby to reduce muzzle lift, especially for larger guns, but such devices also dissipate much of the power that could otherwise be used to discharge the bullet and are distinguishable in operation from compensators which attempt to create a transverse force against the gun barrel in opposition to the direction of the muzzle climb, rather than to create an axial force on the barrel in opposition to the recoil.

An important object of the present invention is to provide an improved compensator for guns that is adjustably and detachably mountable on the muzzle braker, flash hider or flash suppressor of the gun barrel adjacent the muzzle having a number of circumferentially spaced ports (referred to herein as flash hider ports) that are effective in reducing the visibility or flash of the gases discharged from the barrel.

The flash hider ports are provided in a slightly enlarged diameter bore portion of the barrel at the muzzle end, which portion may be considered herein as an expansion chamber and part of the barrel, even though it is usually detachable from the gun to facilitate cleaning for example.

The flash hider ports extend generally radially through the barrel. Accordingly, when the gun is fired, gases flowing axially along the barrel enter the expansion chamber where a portion of their heat energy is converted to kinetic energy. Some of the gases are then discharged transversely of the barrel to the atmosphere. Although such ports are effective in reducing flash and in some instances are designed to reduce recoil and to compensate for muzzle climb, they do not by themselves serve effectively as a compensator because in order to be effective as a flash hider, much of the transversely discharged gas either has no effect in opposing muzzle lift, or actually increases the lift. Where the flash hider ports are designed to be more effective as a compensator, the flash hiding function is seriously impaired, as for example in accordance with the device shown in U.S. Pat. No. 3,971,285, to Ellis et al., where only two flash hider ports are available for use.

Other important objects of the present invention are thus to provide an improved compensator of the type described which is rotatably adjustable on a typical effective flash hider; which utilizes the gases that have already been expanded in the expansion chamber of the flash hider and have already been discharged transversely of the barrel via the flash hider ports; which comprises deflector means external to the flash hider for redirecting the transverse gas flow from one or more of the flash hider ports to oppose the muzzle lift effectively; which may be readily adapted for rotatable adjustment on most flash hiders now in use; and which has circumferentially spaced gas control portions selectively positionable with respect to the flash hider ports by the rotational adjustment for redirecting transversely discharged gases from the ports in predetermined transverse directions to compensate for left or right handed or vertical muzzle climb or lift, as determined by the adjustment.

By virtue of the present invention, some of the transversely discharged gases from the flash hider ports that would otherwise be ineffective in opposing muzzle lift, or might even enhance muzzle lift, are redirected to effect a reaction force opposing the muzzle lift. Furthermore, the energy of such gases that is now used in accordance with the present invention to oppose muzzle lift is extracted from the heat energy of the gases to reduce their temperature and accordingly their visible flash, resulting in minimum impairment of the flash hiding function. Also in contrast to the above mentioned Ellis et al compensator which can only use flash hider ports located above the horizontal axial plane of the gun barrel, the concept of the present invention as described below obtains effective compensation for muzzle lift from flash hider ports located at any circumferential position on the gun barrel. Most military rifles are equipped with flash hiders having circular cylindrical surfaces to accommodate grenade launching therefrom without concern for the angular position of the grenade on the flash hider. Accordingly the soldier in the field may readily adapt his gun to obtain effective compensation for muzzle lift merely by attaching the compensator described herein and rotatably adjusting the same to a desired position to accommodate his particular style of shooting, and in particular to compensate for either left or right hand use or bipod mounting, for example.

Another object is to provide such a compensator selectively adjustable rotatable on a flash hider to a number of selected positions and having locating means cooperable with the flash hider ports for securing the compensator at each selected position.

According to the invention the compensator may have a axially slotted portion fitting around the muzzle end of a gun barrel and the locating means for securing the element on the barrel may comprise a clip for tightening the slotted portion so that it clamps the gun barrel. Alternatively, the locating means may comprise a stop carried by the compensator for engaging a notch in the periphery of the barrel. The stop may be resiliently biased to engage the notch and may be retractable against the resilient biasing.

More specifically, the compensator may comprise a tubular element dimensioned to fit coaxially on the muzzle end of a gun barrel at the region of the flash hider and having at least one compensating vent means disposed or adapted to direct combustion gases discharged transversely from the flash hider ports primarily to one side of the barrel. The locating means for securing the element on the barrel may comprise a stop mounted on the element for passing therethrough and engaging in a flash hider port. The stop may be mounted on a lever for movement to and from a securing portion within the port.

Other objects of this invention will appear in the following description and appended claims, reference being had to the accompanying drawings forming a part of this specification wherein like reference characters designate corresponding parts in the several views.

BRIEF DESCRIPTION OF THE SCHEMATIC DRAWINGS

FIG. 1 is a side elevation of a compensator mounted on a flash hider at the muzzle end of a gun barrel.

FIG. 2 is a transverse sectional view through the flash hider and compensator of FIG. 1, looking leftward, the compensator being adjusted for use by a right handed rifleman the muzzle end of the rifled portion of the gun barrel being shown in phantom.

FIG. 3 is a view of the compensator removed from the gun, looking in the direction of arrow 3 of FIG. 2.

FIG. 4 is a fragmentary section through part of the compensator and part of the flash hider at the region of the locating and securing stop.

FIG. 5 is an elevational view showing a spring clip of the compensator as seen from the left end of FIG. 1.

FIG. 6 is a side elevation of another compensator embodying the present invention, showing the compensator in position for use by a right handed rifleman and also showing a modified means for securing the compensator in a rotatably adjusted position on a flash hider.

FIG. 7 is an end elevation from the left or front end of FIG. 6.

FIG. 8 is an elevational view of the compensator of FIG. 6, looking in the direction of arrow 8 in FIG. 7.

FIG. 9 is a side elevation of an alternative compensator.

FIG. 10 is a transverse sectional view looking rightward, showing the compensator of FIG. 9 mounted on a flash hider.

FIG. 11 is a side elevation of the compensator of FIG. 9 adjusted for a left handed rifleman.

FIG. 12 is a side elevation of another modification of a compensator embodying the invention, shown in position for a bipod mounted weapon.

FIG. 13 is a transverse sectional view looking leftward, showing the compensator of FIG. 12 mounted on a flash hider and adjusted for a right handed rifleman.

FIG. 14 shows the compensator of FIG. 12, looking in the direction of arrow 14 of FIG. 13.

FIGS. 15 through 29 are schematic cross-sectional views illustrating various modification of compensators embodying the present invention and adapted respectively for use with specific types of guns and flash hiders. The views may be considered as seen from the muzzle end, wherein:

FIGS. 15 and 17 show a compensator adjusted for left and right handed riflemen respectively and suitable for use with a flash hider having four sets of flash hider ports located with respect to the hour hand of a clock at 2:00, 4:00, 8:00 and 10:00 o'clock.

FIG. 16 shows the compensator of FIGS. 15 and 17 adjusted for bipod mounting.

FIGS. 18 and 20 are views similar to FIGS. 15 and 17 respectively, but showing a compensator suitable for use with five sets of flash hider ports arranged at 12 o'clock and at 72° intervals.

FIG. 19 shows a compensator adjusted for bipod mounting and useful with a flash hider having ports arranged as in FIGS. 18 and 20.

FIGS. 21 and 23 are views similar to FIGS. 15 and 17 respectively, but showing a compensator suitable for use with six sets of flash hider ports arranged at 12 o'clock and at 60° intervals.

FIG. 22 shows the compensator of FIGS. 21 and 23 adjusted for bipod mounting.

FIGS. 24 through 26 are views similar to FIGS. 21 through 23, showing a modified compensator.

FIGS. 27 through 29 illustrate three additional modifications of compensators embodying the present invention.

Figure 15:
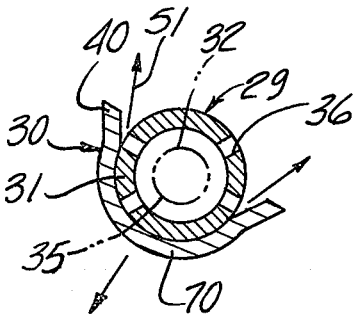

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Referring to FIGS. 1 through 5, a compensator 29 for a gun is shown comprising an elongate tubular element or body portion 30 dimensioned to fit snugly around the cylindrical exterior of a flash hider 31 at the muzzle end of a gun barrel 32 and to be rotatable coaxially thereon to accommodate various firing conditions as explained below. The element 30 has an outlet end 33 with an opening 34 aligned with the rifled bore portion 35 of the barrel 32 through which a projectile can pass.

The flash hider 31 may be a conventional type having four sets of flash hider ports 36 spaced circumferentially 90° apart and located with reference to the hour hand of a clock at 1:30, 4:30, 7:30 and 10:30, as shown in FIG. 2. Each set of ports may comprise three separate holes spaced axially of the barrel as shown in FIG. 4, or may comprise one or more axially extending slots, or other suitable arrangements. In the present instance, the ports 36 extend radially through the cylindrical wall of the flash hider 31 from its central bore 37 which is enlarged with respect to the bore of the rifled portion 35. The bore 37 also extends coaxially beyond the muzzle end of bore portion 35 to provide an expansion chamber into which the gases propelling the bullet or projectile may expand. The expanded gases are then discharged transversely of the axis of the barrel 32. The function of the flash hider in expanding, cooling and breaking-up a portion of the axial gas flow into a number of transverse streams so as to reduce the overall visibility of the flash is well known to the art and is accordingly not discussed further.

A central axially elongated vent 38 extends radially through the cylindrical wall of the element or body portion 30. Two essentially diametrically opposed side vents 39 of similar and parallel shape to the vent 38 are formed in the element 30 at circumferentially spaced locations at opposite sides of the vent 38 which is usually but not necessarily spaced 90° therebetween. Deflectors 40 are formed adjacent the vents 39 and serve to deflect combustion gases that are discharged transversely from the ports 36 generally in the direction of arrows 51. Thus the combustion gases passing through the vents 38 and 39 are directed primarily upwardly and at approximately 45° to one side of a vertical axial midplane of the barrel 32 when the gun is in a firing position. It is also to be noted that without the deflectors 40, the reaction forces of gases discharged from the aligned flash hider ports 36 would neutralize each other and have no lift compensating effect.

For securing the element 30 onto the flash hider 31, a lever 41 is pivotally mounted on pin 42 between mounting ribs 43 on the element 30. A stop 44 on the lever 41 passes into the interior of the element 30 through a radial hole 45 in the peripheral wall of the element. The stop 44 can engage in a suitable flash hider port 36 in the flash hider 31 of the barrel 32. A spring clip 46 mounted on the lever 41 can serve to hold it in the position shown. A retaining catch 47 of the lever 41 engages the rear end of flash hider 31 to assist in locating and in preventing forward movement of the stabilizer 29. An inner wall 48 of the element 30 prevents its backward movement by engaging the muzzle end of the flash hider 31.

As shown in FIGS. 1 through 5, spring clip 46 is pivotally mounted on a pin 49 at the free end of the lever 41 and is partly circular so that it may partly encircle the flash hider 31 or other portion of the barrel 32 and remain in position by virtue of its own resilience. As long as the clip 46 remains in the position shown, the lever 41 keeps the stop 44 in the appropriate port 36 and the element 30 is held in place. The stop 44 can be retracted from the port 36 by releasing the spring clip 46 by merely applying pressure to the latters outwardly bent region 50 and springing the clip 46 off the barrel 32, thus enabling the compensator 29 to be rotatably adjusted to another position or to be removed rapidly from the gun. Removal of the element 30 is necessary, for example, when the rifle is to be used to launch a rifle grenade accurately. In this regard, the lever 41 in the open or unlatched position facilitates mounting of the compensator 29 on a hot gun barrel and is sufficiently long so that it cools rapidly to facilitate removal of a hot compensator 29. The vents 38 and 39 referred to can be either elongated slots or holes or a combination of slots and holes to suit any particular arrangement of flash hider ports of any gun barrel.

Figure 17:
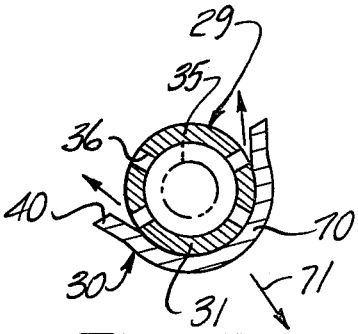

The compensator of the type shown in FIGS. 1 through 5 may also be designed for use with the flash hider usually provided for the 'NATO FN FAL' infantry rifle. When holding such a rifle in its firing position, the marksman can see certain flash hider gas exhaust ports. There are twelve such ports in all, and these can be numbered in four series of three ports each. Proceeding in a clockwise direction as seen by the marksman, series 'A' would be in the 1:30 o'clock position; series 'B' would be in the 4:30 o'clock position; series 'C' would be in the 7:30 o'clock position and series 'D' would be in the 10:30 o'clock position. For a right-handed marksman the compensator 30 is mounted on the flash hider so that the ports of series 'A' are aligned with a central vent 38, enabling combustion gases expelled through the series 'A' ports to escape without deflection. The vents 39 may be merged with vent 38, as illustrated in FIGS. 15 and 17 and the deflectors 40 will be located respectively adjacent to the three ports of series 'B' and the three ports of series 'D.' The gases from the latter six ports strike the deflectors 40 which redirect the gases from their natural transverse path so that they are exhausted in the general direction of the arrows 51, FIGS. 2 or 17, to effect a reaction force against the barrel 32 opposing the muzzle lift. The ports of series 'C' are closed by a cylindrical port restricting portion as described below.

Because the stop 44 engages in a flash hider port 36, it is possible for right or left handed people to use the same compensator. The letter 'R' on the compensator 30 of FIG. 3 is uppermost on the gun barrel when right-handed people are to use the compensator. The letter 'L' will be uppermost for left-handed people. In each case, a port 36 in a different series of flash hider ports is engaged by the stop 44. For a left handed marksman the compensator 29 is mounted on the flash hider 31 so that the ports of series 'D' are aligned with a central vent 38, enabling combustion gases expelled through these ports to escape without deflection. The vents 39 will be aligned with and the deflectors 40 will be located adjacent to the three ports of series 'A' and with the three ports of series 'C' respectively to effect a reaction force against the barrel 32 opposing the muzzle lift.

Without the stabilizer, the NATO FN FAL infantry rifle used by a right handed marksman, when fired on automatic, has a definite tendancy to rise upward and to the right at an angle of approximately 45°. Even if the marksman holds the weapon firmly, the result is highly inaccurate rifle fire with most of the bullets striking above and to the right of the target. This means that automatic fire is wasteful and ineffective due to the high rate at which bullets are expended inaccurately. For 'double tap' shooting, i.e., when the rifle is fired with single rounds in bursts of two shots fired in rapid succession by double-tapping the trigger, the marksman has to re-aim for each 'double tap' because of the tendency of the weapon to rise. Also, when firing single rounds without the compensator, the weapon tends to rise upward and to the right, although the muzzle lift is less noticeable than with fully automatic firing. There is a need to re-aim for each shot, otherwise inaccurate fire will result. Similar problems arise for left handed marksmen but the tendency is for the rifle to rise to the left. Similar problems are encountered with most automatic weapons.

Once the compensator is properly attached to the rifle, the tendency of the rifle muzzle to rise is largely removed. This means that the rifle is more accurate and can be fired more efficiently. When the compensator is held firmly in place on the rifle, there is a tendency for the compensator to pull the weapon forward away from the marksman and thereby to reduce shoulder recoil. Due to a reduction of the recoil, fire with the compensator can be more accurate than without it.

The compensator can be quickly and easily removed from or replaced on a rifle barrel or flash hider without the use of any tools. Thus the rifle can still be used with rifle grenades, blank firing attachments, bayonets, and other accessories. The weapon requires absolutely no alteration in order to enable use of the compensator. The deflectors 40 can also be positioned and dimensioned to redirect gases so as to neutralize any bias, lift or movement experienced with guns which are mounted, whether permanently or temporarily to bipods, tripods, wheels or any fixed or temporary pedestals. The compensators illustrated and described herein can be manufactured from a variety of steels or ferrous or non-ferrous materials at relatively low cost and can be of fairly light weight construction that will not significantly affect the overall weight of the weapon to which it is attached.

Although the compensator has been described above with reference to use on an FN FAL infantry rifle, the compensator can be used on other types of guns. The specific design of the compensator can be readily tailored to accommodate other types of guns, barrel diameters and flash hider designs without departing from the basic compensating features described herein.

Referring to FIGS. 6 through 8, a modified compensator 29 is shown wherein the outlet end 33 has a part-spherical deflector 52 for deflecting combustion gases from the gun barrel generally in the direction of arrow 51*a* in FIGS. 6 and 7.

Although the opening 34 in FIG. 7 appears to be substantially circular when viewed axially of the element 30, it is in fact slightly elliptical because it is inclined to the longitudinal axis of the element 30. The central vent 38 and the essentially diametrically opposed vents 39 are formed substantially as described above. Deflectors 40 are formed adjacent to the vents 39 and serve to deflect combustion gases therefrom generally in the direction of arrows 51 in FIG. 7. Thus, the combustion gases passing through the vents are directed primarily to one side of the element 30 as described above.

By virtue of the muzzle deflector 52, the circumferential extent of the deflectors 40 may be minimized. However, the deflectors 52 for each of the compensators described can be eliminated by suitably dimensioning the deflectors 40 as illustrated in FIGS. 15 through 23 or by providing gas transfer channels in the element 30 to guide combustion gases circumferentially around a portion of the flash hider from its ports located below the horizontal axial plane of the barrel, as illustrated in FIGS. 24 through 29 for example.

The cylindrical body of the element 30 in FIGS. 6 through 8 is provided with rearwardly opening and axially extending slots 53. A clamping or securing device may be located around the slotted end portion of the element 30 and tightened to clamp the compensator onto the flash hider 31.

The compensator 29 shown in FIGS. 9 through 11 also has means for securing it in a rotatably adjusted position on a flash hider 31 and has an outlet end 33 substantially identical to that of FIGS. 6 through 8. However, the compensator of FIGS. 9 through 11 has three substantially rectangular vents 54 which are separated from one another by elongated reinforcing fins 55 extending axially along the periphery of the element 30. The vent 54 between the fins 55 acts in much the same way as the vent 38 of FIG. 8, and thus directs combustion gases generally in the direction of arrow 56, FIG. 10. The other two vents 54 may be spaced essentially 90° in opposite directions from the central vent 54 and each is formed between a fin 55 and a deflector 40. The latter is similar to the corresponding deflector 40 of FIGS. 1 to 3, and the deflectors 40 and fins 55 of FIGS. 9 through 11 serve to deflect combustion gases substantially in the direction of arrows 57 in FIG. 10. Thus the vents and deflectors again serve to direct combustion gases primarily to one side of the compensator 29.

Further in regard to the deflectors 40 shown in any of the drawings herein, the deflectors extend generally axially of the gun barrel 32 for approximately the effective axial extent of the flash hider ports 36 and are preferably closed or connected to the adjacent portion of the cylindrical element 30 at their axially opposite edges by end bracket portions 40*a*. The forward bracket 40*a* or end closure adjacent the muzzle end serves to reduce recoil when impinged by escaping gases. Both brackets 40*a* serve to reinforce the deflector and to prevent its catching on bushes, etc.

The means for securing the compensator 29 of FIGS. 9 through 11 onto a flash hider 31 comprises a lever 58 pivotally mounted at 59 on a mounting 60 of the element 30 and pivotally biased by spring 61, FIG. 11, so that a stop 62 on the lever 58 passes into the interior of the element 30 through a radial hole 63 therein. The stop 62 can engage in a suitable notch in the barrel or in a flash hider port 36 as above described. The spring 61 can serve to hold the stop 62 in the notch. The stop 62 can be retracted against the biasing action of the spring 61 by applying pressure to the lever 58 in the region of the spring 61, thus enabling the compensator 29 to be removed from the flash hider 31 or to be adjustably rotated from one preselected position to another.

The compensator 29 of FIGS. 12 through 14 also has a tubular cylindrical body portion 30 dimensioned to fit snugly onto a flash hider 31 and has an outlet end 33 with an opening 34 through which a projectile can pass. The element 30 in these Figures has vents 38 and 39 and deflectors 40 similar to those described in regard to FIGS. 2 and 3. A curved portion 52 of the outlet end 33 provides a further deflector for axial combustion gases, as described above. The compensator of FIGS. 12 through 14 has an attachment device 64, which is not shown in detail as it is similar to that for conventionally securing a bayonet onto a flash hider or a rifle barrel. However, the device may include a catch or stop similar to the stops 44 and 62 for engaging a notch in the flash hider or barrel.

It is believed to be apparent that by providing a compensator adapted to be rotatably adjusted on a flash hider and having suitable circumferentially spaced deflectors, vents, and port closing or restricting portions selectively positionable with respect to the flash hider ports in accordance with the adjustment, compensation for practically any angle of muzzle climb can be obtained from any flash hider in common use. For optimum efficiency, it will, of course, be necessary to design the gas control means of the compensator to meet the specific requirements of each flash hider, gun, and mode of firing. FIGS. 15 through 29 illustrate the versatility of the present inventions by showing several adaptions to various conventional flash hider port arrangements. Each view is a schematic section of a compensator mounted on a flash hider, as viewed from the muzzle end, and of course, the structural concepts illustrated in any of the views herein may be used with the compensators illustrated in any other view herein.

Figure 16:
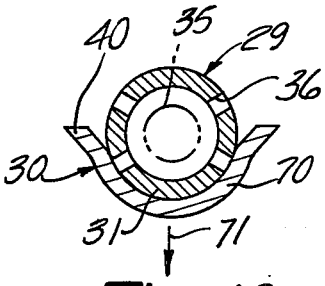

In FIGS. 15 through 17, four flash hider ports 36 or sets thereof are located at the two, four, eight and ten o'clock positions when the gun is in its normal firing position with its sight at twelve o'clock. The compensator 29 is similar to those described above, except that the central vent 38 is widened circumferentially to expose the two o'clock port 36, as seen in FIG. 15, for left hand shooting, or to expose the ten o'clock port 36 when the compensator 29 is rotated to the FIG. 17 position for right hand shooting, or to expose both the two and ten o'clock ports 36 when the compensator 29 is rotated to the FIG. 16 position to oppose vertical lift when the gun is mounted on a bipod.

As illustrated in FIGS. 15 through 17, the vents 38 and 39 described above may be merged into a single large central vent opposite the cylindrical vent restricting portion 70 which substantially closes the eight o'clock port in FIG. 15 and the four o'clock port in FIG. 17.

Inasmuch as the compensator positions in FIGS. 15 and 17 are not necessarily 120° apart, the slits 53 and a clamping band may be used to secure the compensator 29 at its adjusted position, or more than one circumferentially spaced locating stop 44 may be used for selectively aligning one thereof with a port 36 that is closed by restrictor 70 at each position of adjustment. Where reinforcement of the vented region of the compensator is required, circumferentially spaced cylindrical portions of the element 30 may be provided, as in FIG. 2, overlying portions of the flash hider 31 opposite restrictor 70 and such overlying cylindrical portions may be reinforced, as for example, by ribs 55 as in FIGS. 9 and 10.

Figure 18:
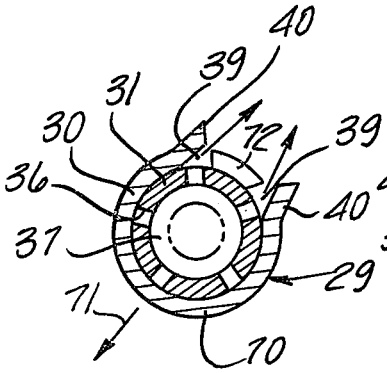
Figure 19:
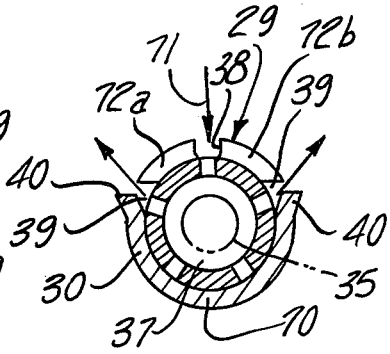
Figure 20:
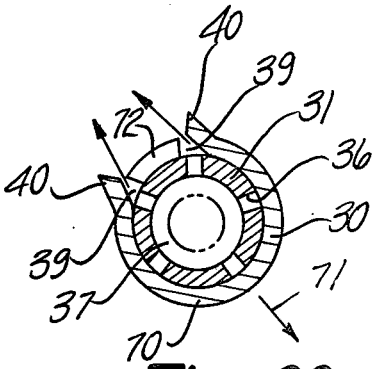

FIGS. 18 and 20 show the left and right hand firing positions for a compensator 29 rotatably adjusted on a flash hider 31 having five ports 36, including one at twelve o'clock and at 72° interval therefrom, wherein the cylindrical port restricting portion 70 of the element 30 extends around the major circumference of the flash hider 31 to close all of its ports 36 except the twelve o'clock port 36 and the clockwise adjacent port 36 when rotated to the left hand firing position of FIG. 18, and except the twelve o'clock port and the counterclockwise adjacent port when rotated to the right hand firing position of FIG. 20. In FIGS. 15 through 20, the two deflectors 40 which extend axially of the circumferentially spaced edges of the port restricting portion 70 as illustrated in FIGS. 3, 8 and 9, for example, also diverge from the cylindrical contours of the portion 70 adjacent to said edges and overlap the two ports 36 respectively that are not closed by the portion 70, thereby to redirect the gases impinging against the deflectors 40 essentially in the direction of the associated arrows to effect a desired resultant reaction force generally in the direction of the arrow 71 opposing muzzle lift.

Where the cylindrical portion 72 between the vents 39 is not required for reinforcement, it may be eliminated as in FIGS. 15 and 17. The two vents 39 will then be merged into a single larger vent.

FIG. 19 illustrates a compensator 29 on a five port flash hider 31 of the type illustrated in FIGS. 18 and 19 but in position to compensate for vertical lift of a hand gun or bipod mounted gun. A central vent 38 aligns with the twelve o'clock flash hider port 36 and the lateral vents 39 align with the flash hider ports 36 spaced 72° in opposite directions therefrom. The compensator 29 of FIG. 19 may also be rotated in either direction from the position shown to align vent 38 selectively with either of the ports 36 adjacent the twelve o'clock port 36 and compensate for left or right hand muzzle climb.

Figure 21:
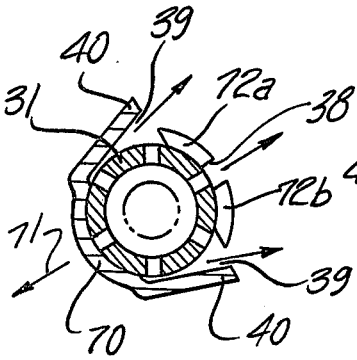
Figure 22:
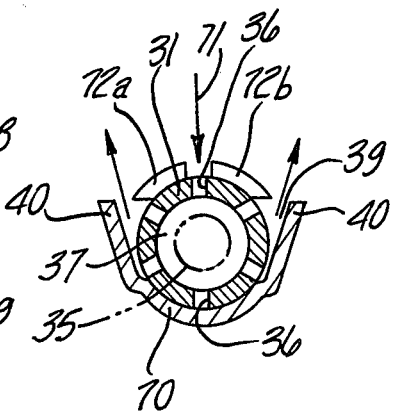
Figure 23:
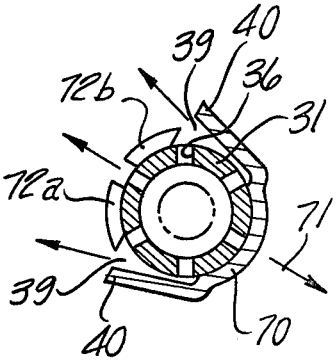

FIGS. 21 through 23 show a modified compensator 29 suitable for use with the five port flash hider of FIGS. 18 through 20 or with a six port flash hider having a twelve o'clock port and five additional ports spaced therefrom at 60° intervals. Each deflector 40 deflects gas discharged from more than one flash hider port and only one port is closed by the restrictor 70. Accordingly improved flash hiding is achieved, rendering the compensator of FIGS. 21 and 22 more suitable for use with higher powered guns, as compared to the compensator of FIGS. 18 through 20. As in FIG. 19, the cylindrical portion of element 30 opposite the cylindrical port restricting portion 70 is partitioned into two circumferentially spaced parts 72*a* and 72*b* to provide the central vent 38 therebetween. The lateral vents 39 are enlarged circumferentially to extend from the circumferentially spaced edges of the restrictor 70 to the adjacent portions 72*a* and 72*b* respectively and each communicates with two flash hider ports 36 to discharge gases therefrom, which gases are then redirected by the deflectors 40 in the general direction of the associated unnumbered arrows to effect a resultant reaction force in the direction of the arrow 71 to compensate for muzzle climb.

The compensator 29 in FIG. 22 is adjusted for bipod support to compensate for vertical lift. The compensators 29 in FIGS. 21 and 23 are rotated 60° in opposite directions from the FIG. 22 position to compensate for left and right handed muzzle climb. Indexing the adjusted position of the compensator 29 in FIGS. 21 through 23 through 60° intervals enables the stops 44 and 62 to be readily used to secure the compensator in its adjusted angular position, but as described above in regard to FIGS. 15 through 17, the 60° indexing is not essential. Any angular adjustment may be made as desired and the resultant reaction force may be directed precisely in any direction by suitable angular adjustment of the compensator 29 with respect to the flash hider and/or by predetermining the angularity of the deflectors 40 and the locations and dimensions of the vents 38 and 39.

Figure 24:
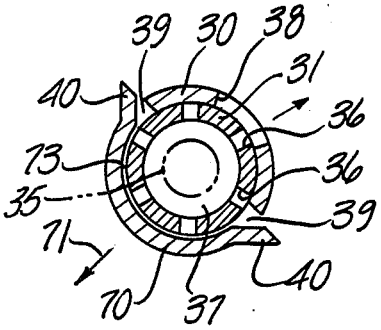
Figure 25:
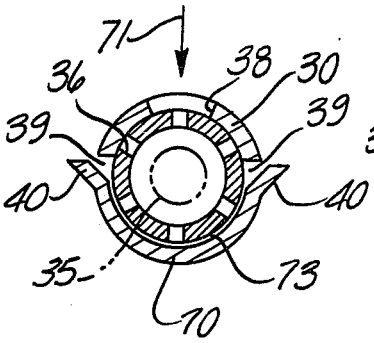
Figure 26:
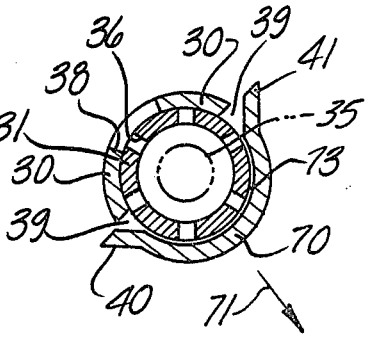

FIGS. 24 through 26 illustrate a modification which further enhances the flash hiding effect of the flash hider 31 and enables use of most of the flash hider ports. The cylindrical restricting portion 70 is spaced radially from the flash hider 31 to provide a gas passage 73 communicating with the flash hider ports 36 within the arc of the portion 70. Gases flowing from such ports are redirected circumferentially and discharged via the vents 39 in the directions determined by the deflectors 40. Such gases in cooperation with gases discharged radially from the unrestricted port 36 at each position effect a resultant reaction force in the direction of the arrow 71. The reaction direction will be vertical in FIG. 25 and approximately 45° from the vertical at the left and right hand firing positions of FIGS. 24 and 26 respectively, whereat the compensator 29 is rotated approximately 45° in opposite directions from the FIG. 25 bipod position.

Figure 27:
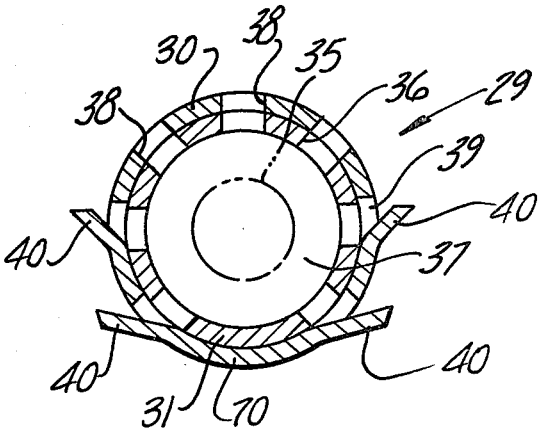

FIG. 27 illustrates the concept of multiple deflectors 40 at opposite sides of the plane of symmetry of the compensator 29. As in the other views, the deflectors comprise paired mirror images that, with or without the passages 73, or 73*a* of FIG. 28, enable use of flash hider ports 36 that would otherwise discharge below the horizontal, thereby to increase the effectiveness of the compensator 29 at various rotational positions of adjustment without seriously impairing the effectiveness of the flash hider 31.

Figure 28:
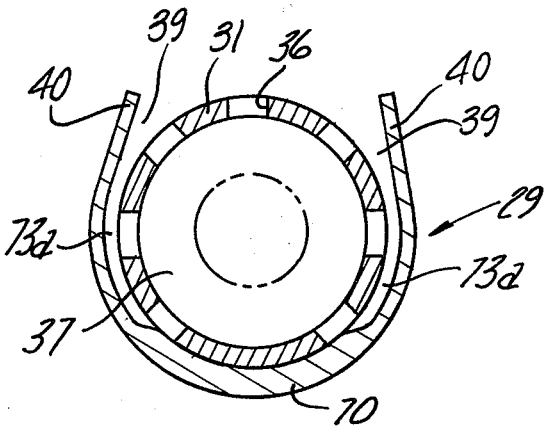

FIG. 28 shows a compensator 29 detachably mounted rotatably on a flash hider 31 having a port 36 at twelve o'clock and every 45° interval therefrom except at six o'clock. The restrictor 70 is centered diametrically opposite the twelve o'clock port 36 and partially restricts the ports 36 at 4:30 and 7:30 o'clock when the compensator is adjusted to compensate for vertical lift. The FIG. 28 construction is particularly suitable for 45° rotation in either direction from the position shown to oppose left or right handed muzzle climb, as described above, whereat the restrictor 70 will close the 7:30 o'clock port 36 or the 4:30 o'clock port 36, respectively. The deflectors 40 extend circumferentially around the flash hider 31 in spaced relationship to deflect gases discharged transversely from more than one port 36 and to provide a pair of passages 73*a* comparable to the passage 73, except that each passage 73*a* opens in only one direction. The restrictor 70 is in sliding and essentially sealing engagement with the cylindrical surface of the flash hider 31 so as to close any port 36 with which it is aligned in the event that over compensation is a problem.

In FIG. 28, gases are discharged from all of the flash hider ports. Although the gas discharge from several ports 36 is concentrated by the compensator, the expansion and turbulence of the gases within the passages 73*a* rapidly dissipates the heat energy of the gases and, aided by the heat lost by conduction through and radiation from the deflectors 40, preserves much of the effectiveness of the flash hider 31 without the compensator 29 mounted thereon.

Figure 29:
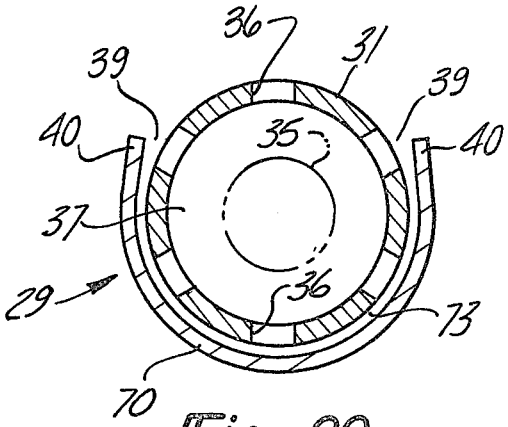

FIG. 29 shows a modification similar to FIG. 28, except that the restrictor 70 is spaced throughout its circumferential extent from the flash hider 31 and the latter has six ports 36 including one at the six o'clock position and at 60° intervals thereafter.

In addition to Ellis et al., U.S. Pat. No. 3,971,285, the following patents are the most pertinent references relating to the present invention known to applicants:

British Pat. No. 606,478—Galliot;
French Pat. No. 1,262,942—Moulin;
U.S. Pat. No. 2,065,273—Galliot;
U.S. Pat. No. 3,179,011—Rahm.

None of the above and no reference known to applicants teach the concept of a compensator removably mountable on a flash hider for rotatable adjustment to various selected positions and having deflectors cooperable with selected flash hider ports at each position for utilizing the gases discharged transversely therefrom and for redirecting those gases to compensate for a particular angle of muzzle lift. Ellis et al shows a rotatable compensator that also has some flash hiding function, but in addition to the distinction and deficiency noted above, they are limited to the use of flash hider ports that discharge upwardly.

The devices in the remaining references are intended for hand guns or machine guns on fixed mountings. They are not rotatable to compensate for other than vertical lift, and even if they were, they would not teach applicants' additional concept of providing a removable compensator that enables use of the flash hider for grenade launching, for example, and that is also rotatably adjustably on the flash hider to predetermine the angle of lift compensation.

We claim:

1. A lift compensator having a longitudinal axis and adapted to be mounted in an operating position on a gun barrel adjacent to the muzzle end, said compensator comprising an element having a sidewall extending longitudinally of said axis and having a plurality of vent means in said sidewall spaced circumferentially around said axis and arranged for communicating with and discharging combustion gases from the barrel transversely of said axis when at said operating position, and means for effecting a reaction force to compensate for transverse muzzle reaction when the gun is fired comprising deflector means associated with selected vent means and extending from said sidewall into the path of the gases discharged transversely from the associated vent means for redirecting said gases in a predetermined different direction transversely of said axis, said compensator adapted for use with a gun having a plurality of flash suppressing ports spaced circumferentially around said barrel adjacent to its muzzle end and communicating with the barrel for discharging combustion gases transversely of said barrel, said vent means being arranged for selective communication with said ports for venting said gases therefrom transversely of said barrel when at said operating position, said element of said compensator comprising a cylindrical sleeve, said vent means comprising two approximately diametrically spaced vents in said sleeve and a third vent in said sleeve between the first two vents, the remainder of said sleeve being impervious to gas flow therethrough.

2. A lift compensator according to claim 1, the portion of said sleeve opposite said third vent having two circumferentially spaced edges, said deflector means comprising a pair of deflectors associated with said edges respectively, said deflectors diverging from the cylindrical contour of the sleeve at said edges and extending into the path of transversely discharged gases from said two vents for redirecting the latter gases transversely of said axis.

3. A lift compensator having a longitudinal axis and adapted to be mounted in an operating position coaxially on a gun barrel adjacent to the muzzle end, said compensator comprising an element having a sidewall extending longitudinally of said axis and having a plurality of vent means in said sidewall spaced circumferentially around said axis and arranged for communicating with and discharging combustion gases from the barrel transversely of said axis when at said operating position, and means for effecting a reaction force to compensate for transverse muzzle reaction when the gun is fired comprising deflector means associated with selected vent means and extending from said sidewall into the path of the gases discharged transversely from the associated vent means for redirecting said gases in a predetermined different direction transversely of said axis, said compensator adapted for use with a gun having a plurality of flash suppressing ports spaced circumferentially around said barrel adjacent to its muzzle end and communicating with the barrel for discharging combustion gases transversely of said barrel, said vent means being arranged for selective communication with said ports for venting said gases therefrom transversely of said barrel when at said operating position, said element of said compensator comprising a tubular element having said vent means therein, said element having port restricting means between at least two of said vent means and selectively aligned with said ports for restricting gas flow through the ports aligned therewith, said port restricting means comprising at least one port restricting portion spacing a pair of vent means and terminating at said pair of vent means in circumferentially spaced edges, said deflector means comprising a pair of deflectors associated with said edges respectively and extending circumferentially and radially outwardly from said edges for entering into the path of transversely discharged gases from said pair of vent means, said two circumferentially spaced edges comprising generally radially extending walls of said pair of vent means, said deflectors diverging from the radially outer portions respectively of their associated walls, each deflector radially overlying at least partially the adjacent one of said two vents.

4. A lift compensator comprising a tubular element adapted to be mounted in an operating position on a gun barrel adjacent to the muzzle end with the tubular sidewall of said element extending longitudinally of the barrel axis, said tubular sidewall having a plurality of circumferentially spaced vent means arranged for communicating with and discharging combustion gases from the barrel transversely of said axis when at said operating position, and means for effecting a reaction force to compensate for muzzle reaction transverse to said axis when the gun is fired comprising deflector means associated with selected vent means and extending into the path of gases discharged transversely of said axis from the associated vent means for redirecting the latter gases in a different direction transversely of said axis, said vent means including a plurality of circumferentially spaced vents in said tubular sidewall, each vent having circumferentially spaced edges in the outer periphery of said tubular sidewall, said deflector means including at least one gas deflector associated with at least one of said vents, said one deflector being integral with said tubular sidewall adjacent to only one of the circumferentially spaced edges of said one associated vent and diverging circumferentially and radially outwardly therefrom into the path of the gases discharged transversely from said one vent for redirecting said gases in said different direction.

5. A lift compensator according to claim 4, said deflector means including a plurality of deflectors associated respectively with a corresponding plurality of said vents, each of said plurality of deflectors being integral with said tubular sidewall adjacent to only one of the circumferentially spaced edges of the associated vent and diverging circumferentially and radially outwardly therefrom into the path of the gases discharged transversely from the associated vent for redirecting said gases in said different direction.

6. A lift compensator according to claim 5, said plurality of deflectors including a second deflector associated with a second of said vents, said one and second deflector diverging outwardly from said tubular sidewall in circumferentially opposite directions.

7. A lift compensator according to claim 6, said vent means including a third vent in said tubular sidewall between said one and second vent.

8. A lift compensator according to claim 4 and adapted for use with a gun having a plurality of flash suppressing ports spaced circumferentially around the gun barrel adjacent to its muzzle end and communicating with the barrel for discharging combustion gases transversely of the barrel, said tubular element being mountable in said operating position on said barrel at the region of said ports, said plurality of vent means being arranged for communicating with selected flash suppressing ports for venting said gases therefrom transversely of said axis when at said operating position, and said tubular sidewall having circumferentially extending port restricting portions between said vent means arranged for aligning at said operating position with selected flash suppressing ports for obstructing the transverse flow of said gases from latter selected ports.

9. A lift compensator according to claim 8, said deflector means including a plurality of deflectors associated respectively with a corresponding plurality of said vents, each of said plurality of deflectors being integral with said tubular sidewall adjacent to only one of the circumferentially spaced edges of the associated vent and diverging circumferentially and radially outwardly therefrom into the path of the gases discharged transversely from the associated vent for redirecting said gases in said different direction.

10. A lift compensator according to claim 9, said plurality of deflectors including a second deflector associated with a second of said vents, said one and second deflector diverging outwardly from said tubular sidewall in circumferentially opposite directions.

11. A lift compensator according to claim 10, said vent means including a third vent in said tubular sidewall between said one and second vent.

12. A lift compensator according to either claim 6 or 10, said tubular sidewall being impervious to gas flow except for said one and second vent.

13. A lift compensator according to either claim 7 or 11, said tubular sidewall being impervious to gas flow except for said one, second, and third vent.

14. A lift compensator according to claim 4, each vent means and associated deflector means extending side-by-side longitudinally of said axis, the deflector means extending circumferentially and radially outwardly with respect to said axis and at least partially overlying the associated vent means radially.

15. A lift compensator according to claim 14, said element comprising a tubular extension of the gun barrel.

* * * * *